United States Patent [19]

Hintsch et al.

[11] Patent Number: 4,640,318

[45] Date of Patent: Feb. 3, 1987

[54] CATCHER FOR A WEAVING MACHINE

[75] Inventors: Otto Hintsch, Wallisellen; Hanspeter Ernst, Winterthur, both of Switzerland

[73] Assignee: Sulzer Brothers Limited, Winterthur, Switzerland

[21] Appl. No.: 810,879

[22] Filed: Dec. 18, 1985

[30] Foreign Application Priority Data

Jan. 24, 1985 [EP] European Pat. Off. ..... 85100679.1

[51] Int. Cl.[4] ..... D03D 47/24

[52] U.S. Cl. ..... 139/439; 139/183

[58] Field of Search ..... 139/439, 435, 183, 185

[56] References Cited

U.S. PATENT DOCUMENTS

| | | | |
|---|---|---|---|
| 3,464,455 | 9/1969 | Brandon | 139/183 |
| 3,685,553 | 8/1972 | Sakamoto | 139/435 |
| 4,404,996 | 9/1983 | Manders | 139/435 |
| 4,442,870 | 4/1984 | Jankovsky | 139/185 |

*Primary Examiner*—Henry S. Jaudon

*Attorney, Agent, or Firm*—Kenyon & Kenyon

[57] ABSTRACT

The weaving machine is provided with a catcher for a projectile which is disposed on a slide so as to be adjustable in the picking direction. In addition, the catcher is adjustably mounted horizontally and vertically transversely to the picking direction in order to permit alignment of the braking channel of the catcher with the guide channel.

4 Claims, 3 Drawing Figures

CATCHER FOR A WEAVING MACHINE

This invention relates to a catcher for a weaving machine.

As is known, weaving machines which employ projectiles for the picking of a weft yarn frequently have a catcher to one side of the weaving machine to receive the projectile after picking. Further, in cases where the weaving machine is constructed to fabricate cloth of different widths, the catchers have been mounted on a support of a weaving machine in a movable manner, that is, in a manner to accommodate the different widths of the cloth. To this end, the catchers have usually been mounted to slide in a direction parallel to the picking direction. At the same time, a sley which carries a guide channel for the projectile is also shortened or lengthened in accordance with the cloth width. However, experience has shown that after a catcher has been moved, the guide channel of the sley and a braking channel in which a projectile is to be subsequently caught may not be in exact registration with one another.

Accordingly, it is an object of the invention to provide a catcher for a weaving machine which can be adjusted to accommodate alignment with a guide channel of a sley after adjustment for different weaving widths.

It is another object of the invention to provide a relatively simple mechanism for adjusting the catcher of a weaving machine to receive a projectile from a guide channel.

It is another object of the invention to provide a relatively simple technique for adjusting a catcher after displacement of the catcher to accommodate a different weaving width.

Briefly, the invention provides a weaving machine which has a guide channel for picking of a projectile therethrough with a slide which is movably mounted in parallel to the guide channel and a catcher having a braking channel for receiving a projectile from the guide channel which is adjustably mounted on the slide for alignment of the braking channel with the guide channel. In this regard, the catcher is mounted on the slide so as to be adjusted horizontally and vertically.

These and other objects and advantages of the invention will become more apparent from the following detailed description taken in conjunction with the accompanying drawings wherein.

Figure 1:
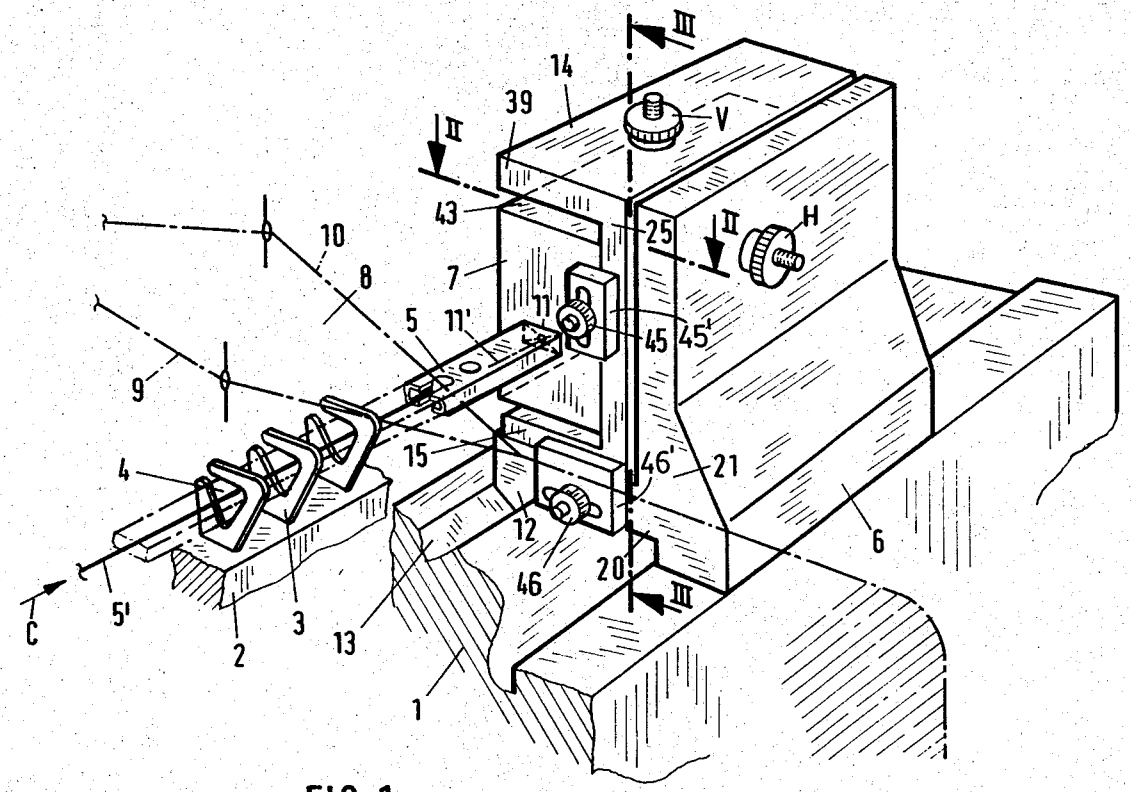
FIG. 1 illustrates a perspective view of a catcher on a catching side of a weaving machine in accordance with the invention.

Referring to FIG. 1, the weaving machine has a main support 1, a sley 2 with guide teeth 3 forming a guide channel 4 for the picking of a projectile 5 therethrough, a slide 6 mounted on the support 1 and a catcher 7 having a braking channel 11 for receiving the projectile 5 from the guide channel 4. As illustrated, a projectile 5 with a trailing weft yarn 5' has just issued from a shed 8 formed by warp yarns 9, 10 and has penetrated to some extent into the braking channel 11 of the catcher 7.

The slide 6 is supported on the main support 1 and is movable in parallel to the picking direction C. To this end, the lower side of the slide, as viewed, is provided with a rib 12 which is slidably received and guided rectilinearly in a groove 13 in the support 1.

In addition, a U-shaped holder is slidably received on the slide 6 for movement transversely relative to the braking channel 11, i.e. horizontally, as viewed. In addition, the catcher 7 is slidably received in the holder 14 for movement transversely of the braking channel 11 and the holder 14, i.e. vertically, as viewed. The catcher 7 also includes a projectile brake (not shown) for braking the entering projectile 5 in the braking channel 11 to a stop, as is known.

Figure 2:
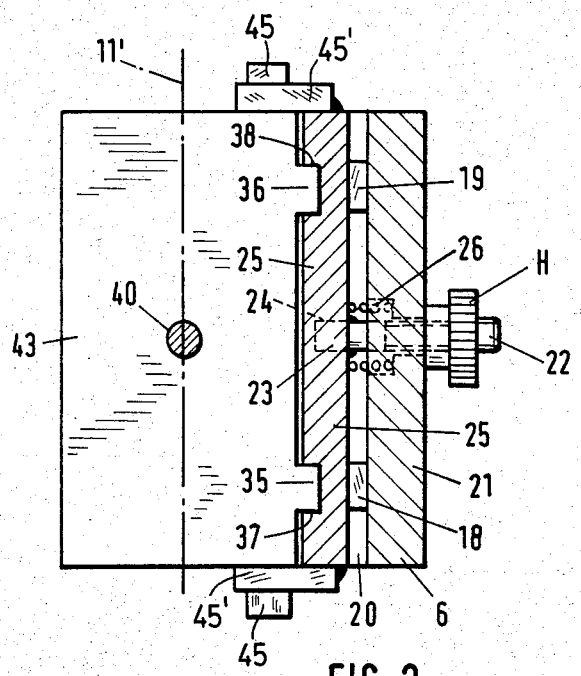
FIG. 2 illustrates a view taken on line II—II of FIG. 1.
Figure 3:
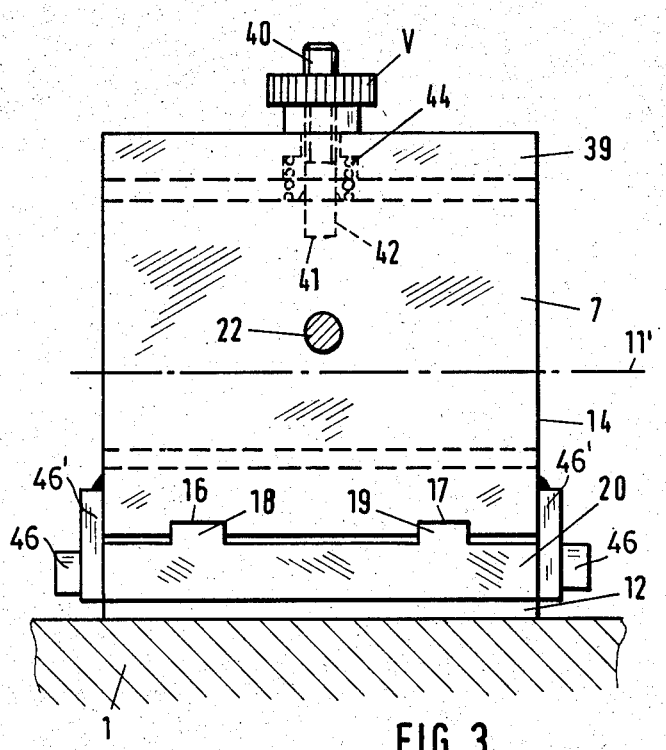
FIG. 3 illustrates a view taken on line III—III of FIG. 1.

A suitable means is provided for the horizontal adjustment of the holder 14 on the slide 6. For example, as indicated in FIG. 3, a bottom flank 15 of the holder 14 is formed with two horizontal grooves 16, 17 in which a pair of ribs 18, 19, respectively, on a base 20 of the slide 6 are slidably received. In addition, as indicated in FIG. 2, an adjusting screw 22 passes through a wall 21 of the slide 6 and has a threaded end 23 threaded into a tapped bore 24 in an opposed wall 25 of the holder 14. A spring 26 is also located between the walls 21,25 of the slide 6 and holder 14 to bias the walls apart while an adjusting nut H is threaded on the screw 22 against the outside of the slide wall 21 to secure the holder 14 in place. By turning of the nut H, the holder 14 is moved horizontally relatively to the slide 6.

A means for the vertical adjustment of the catcher 7 within the holder 14 is also provided. For example, as indicated in FIG. 3, the catcher 7 is provided with two vertical ribs 35, 36 which slidably engage in vertical grooves 37, 38, respectively in the wall 25 of the holder 14. In addition, an adjusting screw 40 passes through the top flank 39 of the holder 14 and has a threaded end 41 secured in a tapped bore 42 in a top side 43 of the catcher 7. In addition, a return spring 44 is disposed between the catcher 7 and the top flank 39 of the holder 14 to bias the holder 7 vertically downwardly away from the top flank 39. An adjusting nut V is also threaded on the screw 40 so as to fix the location of the catcher 7 relative to the top flank 39 of the holder 14. Thus, upon rotation of the nut V, the vertical height of the catcher 7 can be adjusted relative to the holder 14 and thus relative to the guide channel 4.

In order to align the braking channel 11 of the catcher 7 to the guide channel 4, a profiled gauge comparable with an over-length projectile is first introduced into the guide channel 4. The slide 6 is then pushed to the correct distance from the guide channel 4 and secured in place. Next, the catcher 7 is moved horizontally and/or vertically by means of the adjusting nuts H, V until the gauge can slide into the braking channel 11. The longitudinal axis 11' of the braking channel 11 then coincides with the longitudinal axis of the guide channel 4. When this position has been reached, the catcher 7 can be secured to the holder 14, for example, by means of two screws 45 and associated clamping plates 45' which are secured at opposite ends of the catcher as indicated in FIGS. 1 and 2. As indicated in FIG. 2, each clamping plate 45' is welded to the wall 25 of the holder while the screws 45 are threaded into suitable bores (not shown) in the catcher 7. Further, each clamping plate 45' is provided with an elongated slot accommodate vertical movement of the screw 45 with the catcher 7. In like manner, a pair of screws 46 and associated clamping plates 46' serve to secure the holder 14 in the slide 6. As indicated in FIGS. 1 and 3, each clamping plate 46' is welded to the holder 14 while the associated screw 46 is threaded into the slide 6. Also, a suitable elongated slot is provided in the clamping plate 46' to accommodate the associated screw 46 for horizontal adjustment of the holder 14 relative to the slide 6.

The invention thus provides a catcher for a weaving machine which can be readily adjusted horizontally and vertically to align with the guide channel for a projectile after adjustment for a different weaving width onthe weaving machine.

What is claimed is:

1. In a weaving machine having a guide channel for picking of a projectile therethrough, the combination comprising a catcher having a braking channel for receiving a projectile from said guide channel;

a holder slidably receiving said catcher therein for movement transversely relative to said braking channel;

a slide slidably receiving said holder therein for movement transversely relative to said braking channel and said holder; and a support slidably receiving said slide for movement parallel to said guide channel and said braking channel.

2. The combination as set forth in claim 1 wherein said catcher is adjustable horizontally and vertically in said slide.

3. In a weaving machine having a guide channel for picking of a projectile therethrough, the combination comprising a catcher having a braking channel for receiving a projectile from said guide channel;

a holder slidably receiving said catcher therein;

means for adjusting said catcher within said holder transversely relative to said braking channel; and a support slidably receiving said holder for movement parallel to said guide channel and said braking channel.

4. The combination as set forth in claim 3 which further comprises a slide slidably receiving said holder and means for adjusting said holder within said slide horizontally of said braking channel.

* * * * *